US007225575B2

(12) United States Patent
Kiesel, II et al.

(10) Patent No.: US 7,225,575 B2
(45) Date of Patent: Jun. 5, 2007

(54) METHOD AND DEVICE FOR PROVIDING AN INTEGRAL FIREARMS SAFETY LOCK MECHANISM

(75) Inventors: Joseph N. Kiesel, II, East Kingston, NH (US); Richard L. Strout, Exeter, NH (US)

(73) Assignee: Sigarms, Inc., Exeter, NH (US)

( * ) Notice: Subject to any disclaimer, the term of this patent is extended or adjusted under 35 U.S.C. 154(b) by 0 days.

(21) Appl. No.: 10/880,570

(22) Filed: Jul. 1, 2004

(65) Prior Publication Data

US 2005/0011099 A1 Jan. 20, 2005

Related U.S. Application Data

(60) Provisional application No. 60/483,653, filed on Jul. 1, 2003.

(51) Int. Cl.
*F41A 17/00* (2006.01)

(52) U.S. Cl. ..... 42/70.08; 42/70.01

(58) Field of Classification Search ..... 42/70.08, 42/70.01, 70.11
See application file for complete search history.

(56) References Cited

U.S. PATENT DOCUMENTS 3,750,531 A * 8/1973 Angell et al. ..... 89/148
4,021,955 A * 5/1977 Curtis ..... 42/70.08
4,726,136 A * 2/1988 Dornaus et al. ..... 42/70.08
5,259,137 A 11/1993 Blenk et al.
5,259,138 A * 11/1993 Scirica ..... 42/70.08
5,305,540 A 4/1994 Blenk
5,353,539 A 10/1994 Zeh
5,363,581 A 11/1994 Blenk et al.
5,437,120 A * 8/1995 Dornaus ..... 42/70.08
5,458,046 A 10/1995 Blenk et al.
5,493,806 A * 2/1996 Langevin et al. ..... 42/69.02
5,899,013 A 5/1999 Hauser et al.
D428,101 S 7/2000 Rost et al.
6,112,446 A 9/2000 Forster et al.
6,141,895 A 11/2000 Rost et al.
6,173,518 B1 1/2001 Oberst
6,234,059 B1 5/2001 Fuchs et al.
6,240,670 B1 * 6/2001 Findlay ..... 42/70.08
6,253,479 B1 7/2001 Fuchs et al.
6,260,298 B1 7/2001 Bubits
6,263,607 B1 7/2001 Fuchs et al.
6,266,909 B1 7/2001 Fuchs et al.
6,289,619 B1 9/2001 Fuchs et al.
6,293,039 B1 9/2001 Fuchs (Continued)

FOREIGN PATENT DOCUMENTS

DE 3808102 A1 * 10/1989

OTHER PUBLICATIONS

"SIGARMS SIG SAUER Pistol Owners Manual", pp. 1-39, 2001.

*Primary Examiner*—Michelle Clement
(74) *Attorney, Agent, or Firm*—Nixon Peabody LLP; Donald R. Studebaker

(57) ABSTRACT

The present invention provides an integral firearms safety lock that safely provides locking capabilities in a firearm. The integral firearms safety lock ensures that a firearm is unable to fire by a simple manual manipulation of a locking mechanism. Moreover, an integral firearms safety lock is provided that contacts and locks a firing pin safety thereby preventing any unauthorized firing of the firearm.

13 Claims, 9 Drawing Sheets

U.S. PATENT DOCUMENTS 6,389,728 B1 * 5/2002 Lundy ..... 42/70.11
6,405,470 B1 6/2002 Strahan
6,481,135 B2 11/2002 Zeh et al.
6,502,344 B1 1/2003 Zeh et al.
6,510,639 B2 1/2003 McMoore
6,513,273 B2 * 2/2003 da Silveira ..... 42/70.08
6,519,888 B1 2/2003 Oberst
6,725,592 B2 4/2004 Reed
2005/0229461 A1 * 10/2005 McGarry ..... 42/70.08
2005/0229462 A1 * 10/2005 McGarry ..... 42/70.08

* cited by examiner

METHOD AND DEVICE FOR PROVIDING AN INTEGRAL FIREARMS SAFETY LOCK MECHANISM

The present application claims priority under 35 U.S.C. 119(e) to U.S. Provisional Patent Application No. 60/483,653 filed on Jul. 1, 2003, which is incorporated herein by reference, in its entirety.

BACKGROUND OF THE INVENTION

1. Field of the Invention

The present invention relates generally to a safety lock for use in a firearm. In particular, an exemplary embodiment of the present invention relates to a lock that is integrally connected to the firing pin safety so as provide an efficient integral firearms safety lock mechanism.

2. Background

In recent years, due to an increase in the number injuries and deaths resulting from accidental gun discharges, many organizations are looking for solutions to reduce and eliminate these incidences. Moreover, the trend of injuries and deaths has been of an increasing concern since many of the incidences occur with children.

Manual safeties are provided on many firearms available today. The manual safeties provide a way for a firearm user to manually actuate a switch located on the firearm to prevent an unexpected firing of the firearm. The safety can prevent a firearm from discharging in a situation where it is mishandled while, being holstered, or jostled when located near a person's body. By actuating the manual safety switch, the firing mechanism of the firearm is blocked so it cannot move to fire a bullet.

However, the use of a manual safety is only recommended as a preventative measure when the firearm is being handled (but not fired) and is not especially helpful to prevent unauthorized use of the firearm. For example, if the firearm is placed in the hands of a person inexperienced in firearm handling (e.g., a child), the child could accidentally or otherwise release the manual safety of the firearm thereby enabling the firing of the firearm by actuation of the trigger.

There continues to be a need for a mechanism to prevent unauthorized use of a firearm. In response to this need as well as to recent laws requiring a locking mechanism, firearm safety locks have been proposed to solve this problem and to provide an additional, manner of locking a firearm. A firearm lock provides the specific advantage that it can only be actuated by a unique key associated with the lock, and unauthorized users (e.g., thieves, children, or the like) are unable to inadvertently or purposefully unlock the firearm.

Many types of firearm safety locks have been provided in order to ensure safety. For example, some safety locks can be inserted into a portion of a firearm to prevent the firearm from firing. For example, in U.S. Pat. No. 6,725,592 to Reed, a non-integral firearm safety lock is inserted into a firearm's firing chamber ejector and loading port, and is expanded and locked to prevent the weapon from being fired. Once the firearm safety lock is inserted into the firearm's open chamber, a key is used to expand a locking plate that is forced downward, fills and seals the loading port, which disables the weapon. While this type of lock secures the weapon, there is an inordinate amount of manual manipulation required to actually lock the firearm.

Additionally, U.S. Pat. No. 6,405,470 to Strahan discloses an integral firearm safety lock that employs a locking element formed to directly prevent the firing pin from moving to strike a bullet. While the locking of the firearm is simpler than the lock described above, there are several disadvantages to employing this locking element that is in direct contact with the firing pin. For example, when employing a screw to lock the firing pin, as Strahan does, there is no certainty that a manual action (rotation of the screw) will lock the device. In other words, a person can attempt to lock the device, by rotating the screw, and feel that the device has been locked, when in actuality, the screw has not actually contacted the firing pin to prevent firing. What is needed is an integral firearm lock that provides maximum protection as well as certainty of locking.

SUMMARY OF THE INVENTION

Accordingly, the present invention provides an integral firearms safety lock that is able to safely provide locking capabilities in the firearm and to ensure that a firearm can be made unable to fire by a simple manual manipulation of a locking mechanism. Moreover, in accordance with an exemplary embodiment of the present invention, an integral firearms safety lock is provided that contacts and locks a firing pin safety thereby preventing any unauthorized firing of the firearm.

In accordance with an exemplary embodiment of the present invention, an integral firearms safety lock for preventing movement of a firing pin safety is disclosed. The integral firearms safety lock comprises a locking shaft and a detent pin. The locking shaft further includes a recess and a contact area while the detent pin contacts the locking shaft in a contact area. The locking shaft can be rotated between an unlocked position and a locked position. In the unlocked position, the locking shaft permits movement of the firing pin safety and, in the locked position, the locking shaft contacts the firing pin safety to prevent its movement.

In further exemplary embodiment of the present invention, the contact area of the locking shaft includes a first detent including a first stop and a second detent including a second stop. Also, the detent pin is positioned in the first detent when the locking shaft is in an unlocked state and is positioned in the second detent when the locking shaft is in a locked state.

In a further exemplary embodiment of the present invention, the locking shaft and the detent pin are integral to the firearm. Additionally, the locking shaft further includes a chamfer to enable removal of the locking shaft from the firearm.

In accordance with yet another exemplary embodiment of the present invention, a method for locking a firearm so as to be unable to fire is disclosed. The method comprises inserting a tool into an end of a locking shaft located in the firearm. The tool is used to rotate the locking shaft from an unlocked position to a locked position. A radial portion of the locking shaft rotates into a groove located in a firing pin safety. In the locked position, the locking shaft contacts the firing pin safety to prevent movement of the firing pin safety. The tool is removed from the end of the locking shaft.

BRIEF DESCRIPTION OF THE DRAWINGS

The above and other aspects, features and advantages of this invention will be described in relation to the following figures in which like reference characters refer to the same parts throughout the different views.

DETAILED DESCRIPTION

An exemplary embodiment of the present invention relates to a firearm safety lock mechanism and method for use. Although specific embodiments will be illustrated and described herein with regard to its implementation within handguns, it should be appreciated by those of ordinary skill in the art that such a system and method would also be advantageous, for example, for any type of firearm in which a slide is employed. Additionally, this application is intended to cover any adaptations or variations of the present invention that generally relate to firearm safety locks.

In the following detailed description of the exemplary embodiments, reference is made to the accompanying drawings that form part hereof, and in which is shown by way of illustration, specific exemplary embodiments in which the invention may be practiced. These embodiments are described in sufficient detail to enable those skilled in the art to practice the invention, and it is to be understood that other embodiments may be utilized and that logical, mechanical changes may be made without departing from the spirit and scope of the present invention. The following detailed description is therefore not to be taken in a limiting sense.

Figure 1:
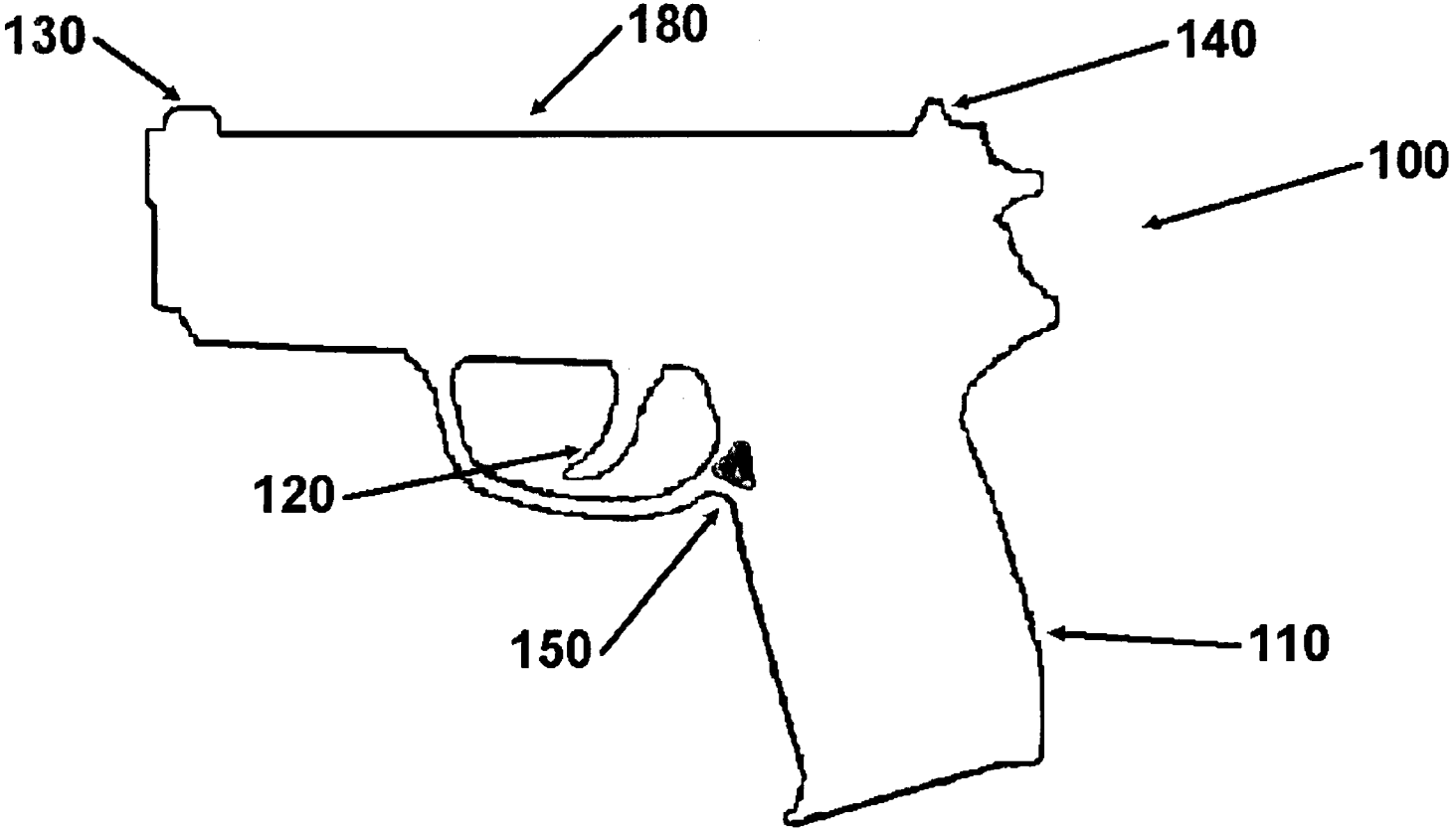
FIG. 1 is a diagram illustrating a conventional firearm wherein exemplary embodiments of the present invention can be employed.
Figure 2:
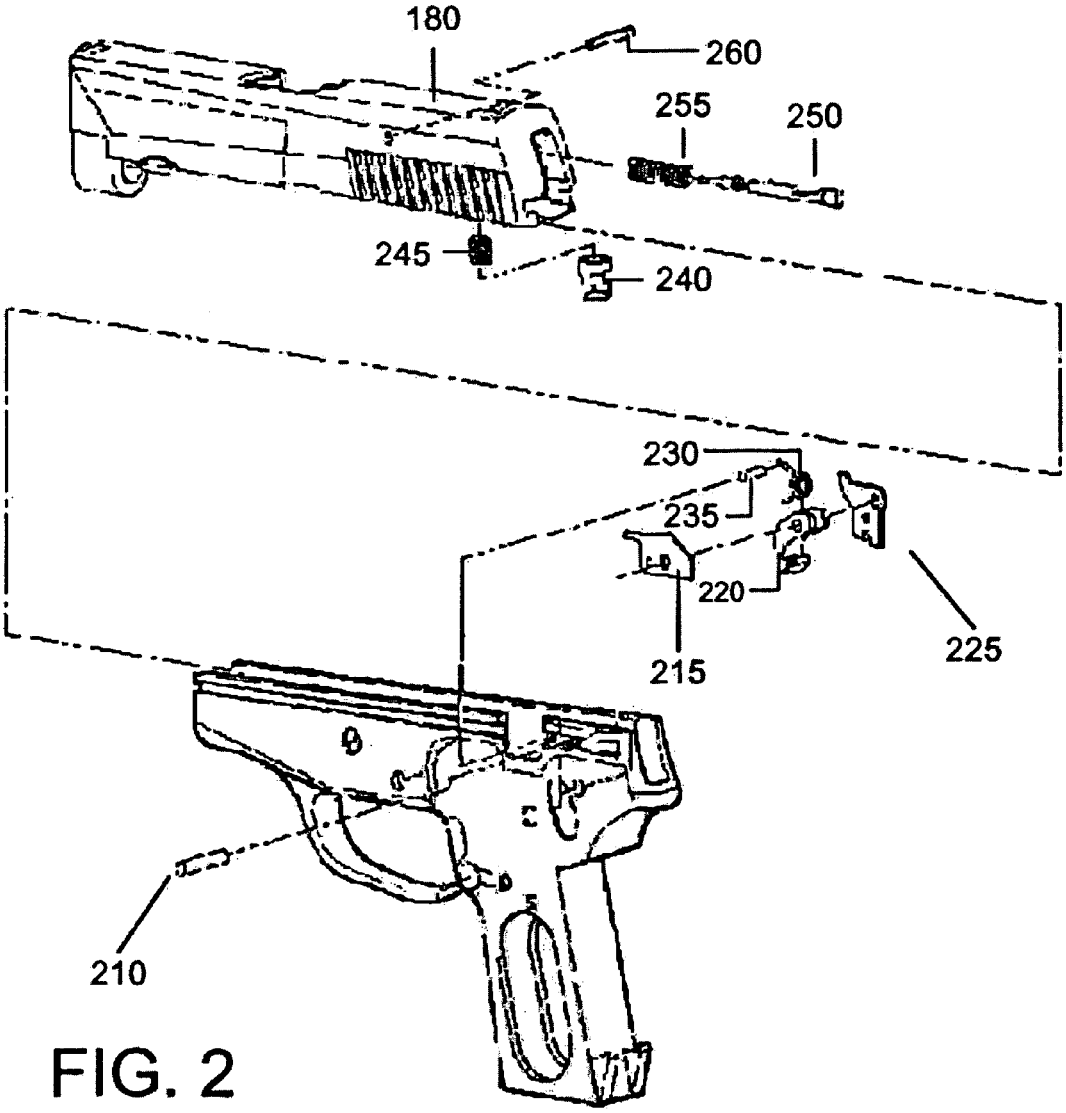
FIG. 2 is an exploded perspective view of various parts associated with the slide of a conventional firearm in accordance with an exemplary aspect of the present invention.

Referring now to FIG. 1, a conventional firearm 100 (e.g., a handgun) is shown. The firearm 100 includes, among many other parts, a grip 110, a trigger 120 a front sight 130 a rear sight 140, a magazine catch 150 and a slide 180. Providing more specificity, FIG. 2 depicts a partial exploded view of the conventional firearm 100 described generally above with regard to FIG. 1. Specifically, FIG. 2 discloses some of the integral parts associated with the function of a safety lever 225. As is shown, the firearm 100 also includes a pivot pin 210 for a sear 220 and safety lever 225, an ejector 215, sear spring 230 and roll pin 235. Additionally, several parts are located within the slide 180. Specifically, a firing pin safety 240 and firing pin safety spring 245, a firing pin 250 and associated firing pin spring 255 as well as a firing pin bolt 260 are illustrated. For the purpose of urging firing pin 250 rearward, spring 255 is provided, one end of which abuts against an internal surface of the slide 180 and the other end of which abuts against a surface of the firing pin 250.

In normal operation, when a firearm user wishes to discharge the firearm 100, the trigger 120 is pulled. When the trigger 120 is pulled, the firearm 100, through actuation of a plurality of known mechanical parts that comprise the firing mechanism of the firearm, manually actuates the safety lever 225. The safety lever 225 rotates around the pivot pin 210 and contacts the firing pin safety 240. The firing pin safety 240 is then forced to move upward against a bias provided by the firing pin safety spring 245. The movement of the firing pin safety 240 upward enables the firing pin 250 to be actuated and thereby cause firing of the firearm 100. Conversely, when the firing pin safety 240 is unable to or is prevented from moving upward, the firing pin 250 is unable to move to allow discharge of the firearm 100.

Figure 3:
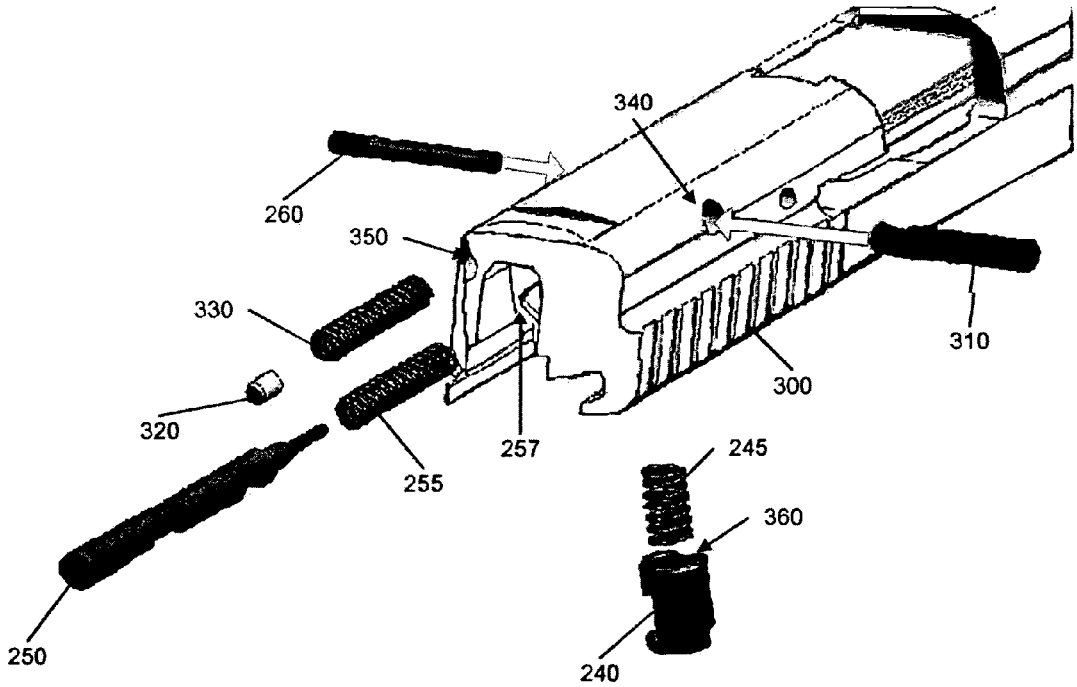
FIG. 3 is a perspective view of the integral firearms safety lock mechanism and associated parts provided in a firearm slide in accordance with the present invention.

FIG. 3 provides an exploded view of a slide 300 that includes the integral firearms safety locking mechanism provided in accordance with an exemplary embodiment of the present invention. The integral firearms safety locking mechanism of the present invention includes a locking shaft 310 for insertion into a hole 340 and a detent pin 320 and associated detent pin spring 330 for insertion into a hole 350 located on the slide 300 as the detent pin 320 secures the locking shaft 310 in either a locked or unlocked position. The detent pin spring 330 applies tension between the locking shaft 310 and the detent pin 320.

In accordance with the present invention, FIG. 3 also illustrates that the firing pin safety 240 includes a cutout portion 360 (shown in more detail in FIG. 4A and FIG. 4B) to which the locking shaft 310 abuts, when the safety locking mechanism is locked. As is well known, firing pin 250 is disposed in a hole 257 formed in slide 300. When the integral safety lock of the present invention is in a locked position, the firing pin safety 240 is unable to move upward and thus is unable to free the firing pin 250 to move and fire a bullet.

Figure 4A:
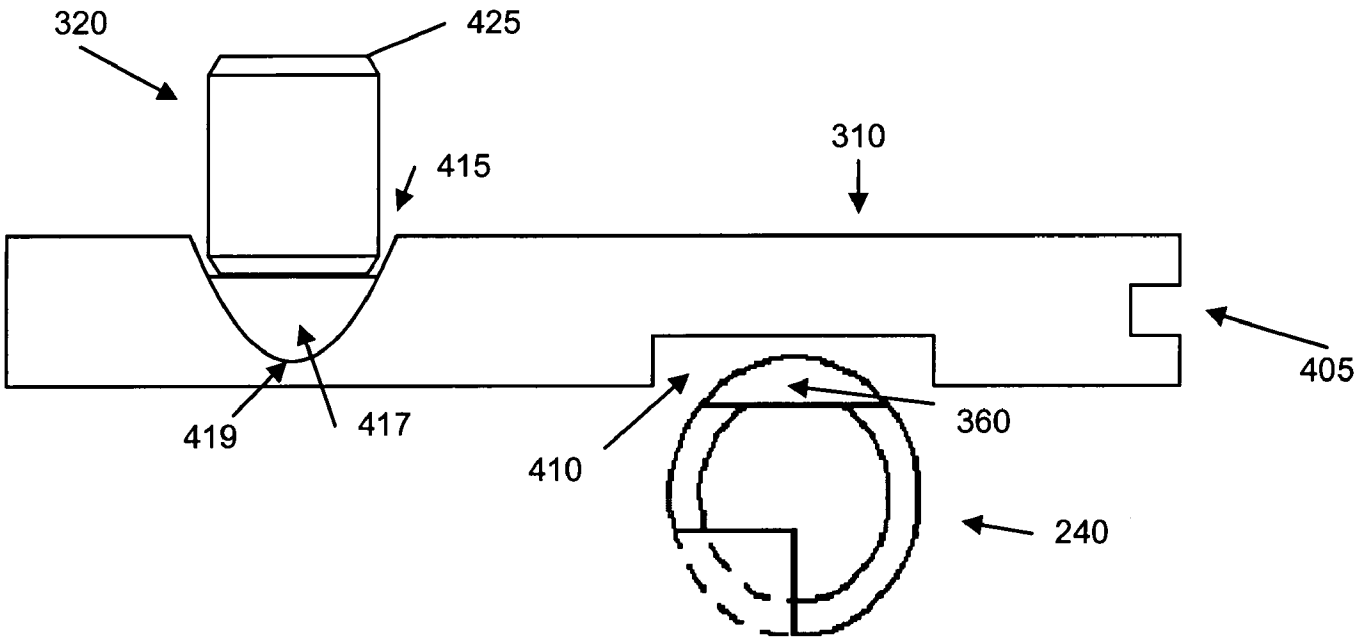
FIG. 4A is a diagram depicting the integral firearms safety lock of the present invention in an unlocked position in accordance with an exemplary aspect of the present invention.

FIG. 4A illustrates the integral safety lock mechanism of the present invention in an unlocked state. Locking shaft 310 lies transversely across the shaft of the firearm in the hole 340, as illustrated in FIG. 3. The locking shaft 310 includes a detent pin contact area. The detent pin contact area includes two detents 415 and 417 located at the end of the locking shaft 310 inserted into hole 340 (not shown in FIG. 4A). Each detent includes a stop, 421 and 419 (see FIG. 5A) respectively, to prevent further movement of the detent pin 320 as the locking shaft is rotated.

The two detents 415 and 417, located on the insertion end of the locking shaft 310 enable the locking shaft 310 to be rotated from an unlocked state to a locked state and from a locked state to an unlocked state. The stops are situated approximately 90 degrees apart, and the field of movement of the locking pin when moving from a locked state to an unlocked state and from an unlocked state to a locked state. The use of detent pin 320 and detent pin spring 330 places a downward bias on the detent pin 320 enabling the locking shaft to stay in either the locked or unlocked position as well as to stay positioned in the hole 340. Additionally, detent pin 320, in one exemplary embodiment of the invention, includes a tapered end 425 to provide the locking mechanism a smooth transition from one state to another.

The locking shaft 310 also includes a recess 410 located on a longitudinal portion of the locking shaft 310. The recess 410 provides a passage through the locking shaft for the firing pin safety 240 when the safety locking mechanism is unlocked. As shown in FIG. 4A, when the detent pin 320 is in detent 415, the recess is positioned so as to permit movement of the firing pin safety and, as a result, firing of the firearm 100.

Located on one exterior end of the locking shaft is an indentation 405 (e.g., a uniquely shaped recess) which allows a tool to interface and rotate the shaft. The tool (e.g., a key) enables only authorized personnel to lock and unlock the integral firearms safety lock of the firearm 100. The locking shaft also includes a recess 410 that allows free movement of the firing pin safety 240.

Figure 4B:
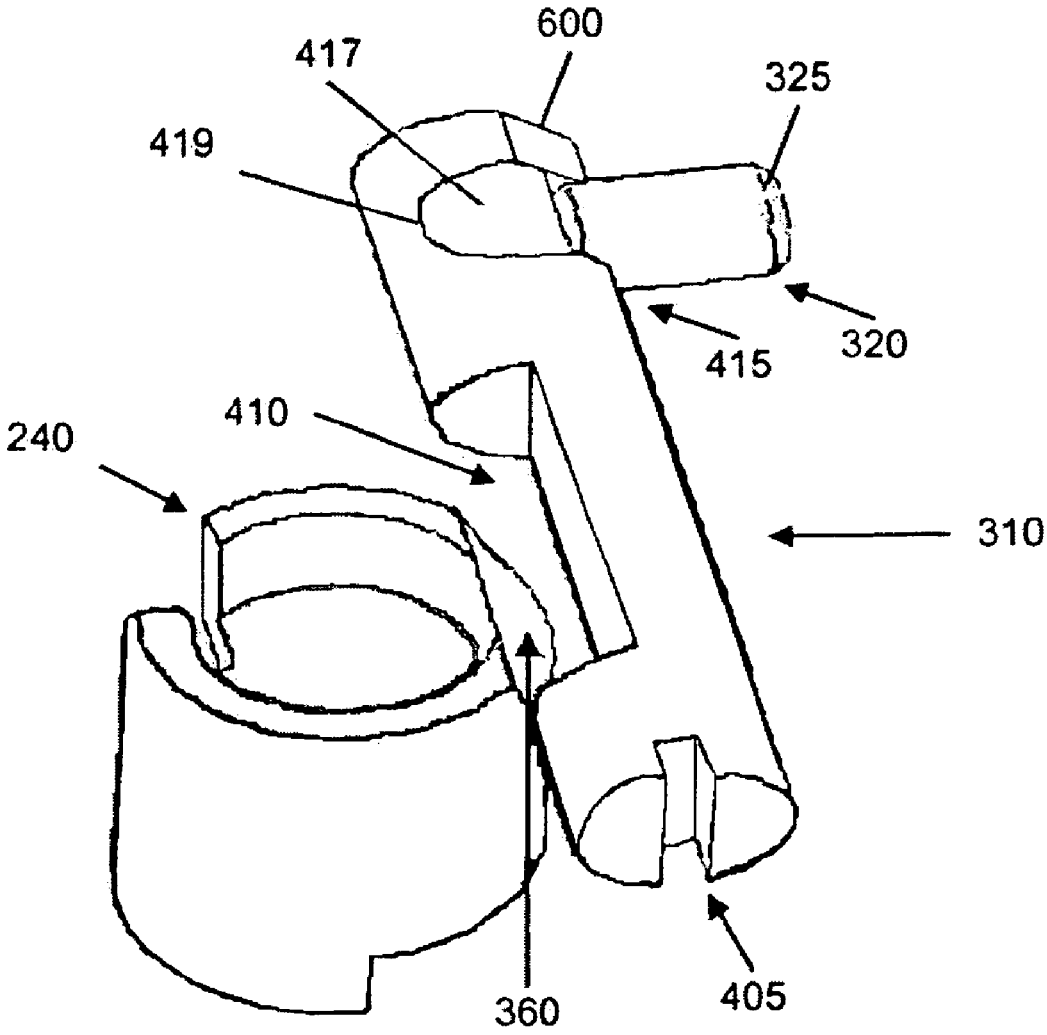
FIG. 4B is a perspective view of the integral firearms safety lock of the present invention in an unlocked position in accordance with an exemplary aspect of the present invention.

FIG. 4B provides a perspective view of the locking pin in an unlocked state. Specifically, when the locking pin 310 is in the unlocked position, the firing pin safety 240 is free to move through recess 410 of the locking pin 310. As discussed above, when a user pulls the trigger 120, the firearm 100, actuates the safety lever 225. The safety lever 225 rotates around the pivot pin 210 and contacts the firing pin safety 240. The firing pin safety 240 is then forced to move upward against a bias provided by the firing pin safety spring 245. When the integral firearms safety locking mechanism is unlocked as described above, the movement of the firing pin safety 240 upward is not inhibited, which enables the firing pin 250 to be actuated to cause firing of the firearm 100.

Figure 5A:
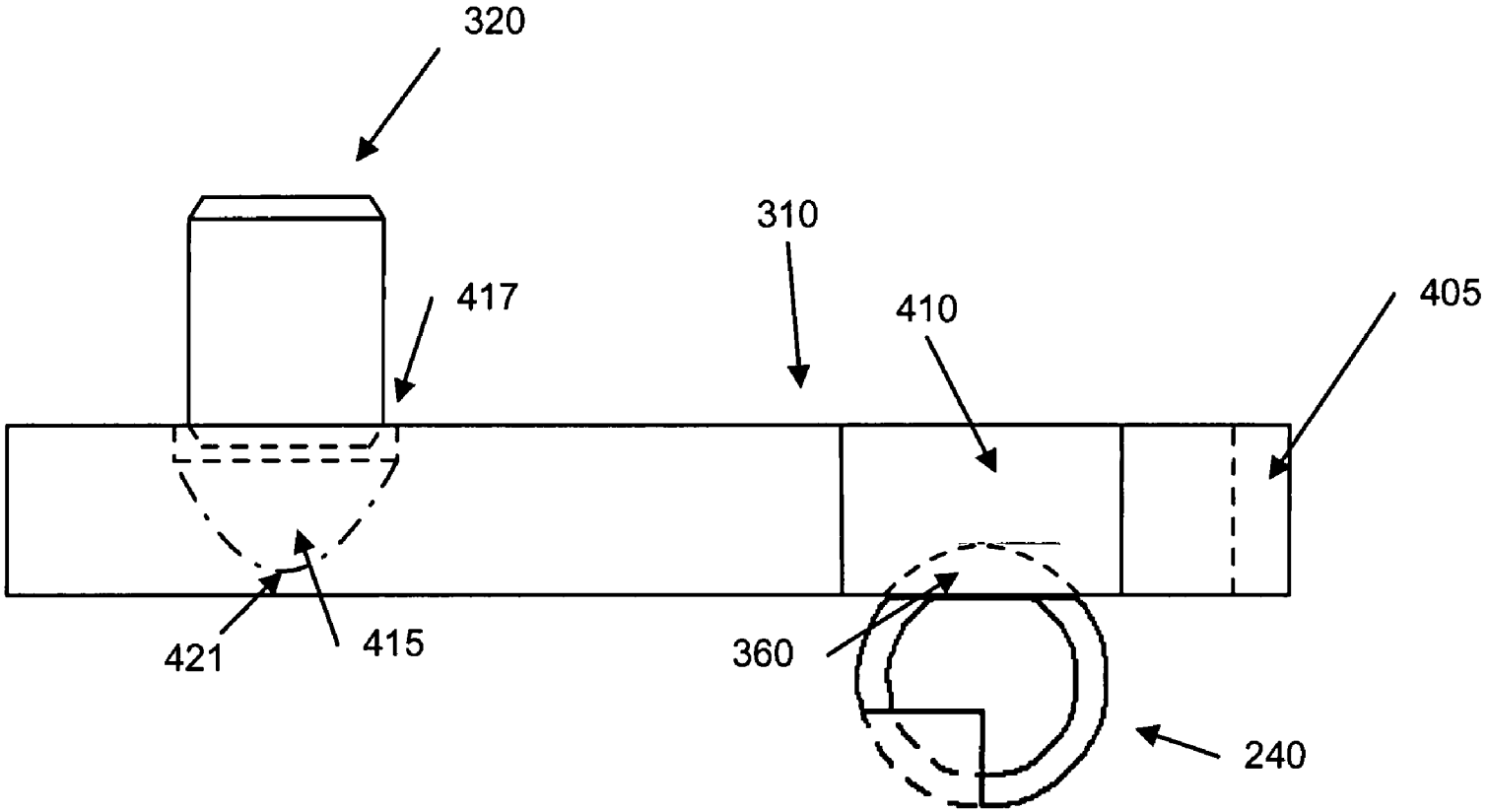
FIG. 5A is diagram depicting the integral firearms safety lock of the present invention in a locked position in accordance with an exemplary aspect of the present invention.

FIG. 5A provides a view of the locking shaft 310 in a locked position. Locking occurs when a key (discussed above) or another like object, is inserted into the indentation 405 located on the face of the locking shaft 310, mounted in the slide 300, and rotated 90 degrees from the unlocked position. The internal safety lock holds the detent pin 320 in the detent 417 under a spring tension. By restricting the safety lock to 90 degrees of movement between unlock and lock or vice versa, a user easily knows that the firearm is either in the locked or unlocked position. All a user needs to do is rotate the key from one position (either locked or unlocked) 90 degrees to the other position (either unlocked or locked) to the stops placed at the ends of the detents.

As the locking shaft 310 rotates, recess 410 is rotated so as to face away from the end of the firing pin safety 240. As a result, the locking shaft 310 now blocks movement of the firing pin safety 240. More specifically, when the key is being used to place the locking shaft into the locked state, the radial part of the locking shaft 310 will rotate into a groove 360 located in the firing pin safety 240, thus restricting its movement. Since the movement of the firing pin safety 240 is restricted, the safety lever 225 is also restricted, preventing a discharge of the firearm 100.

Figure 5B:
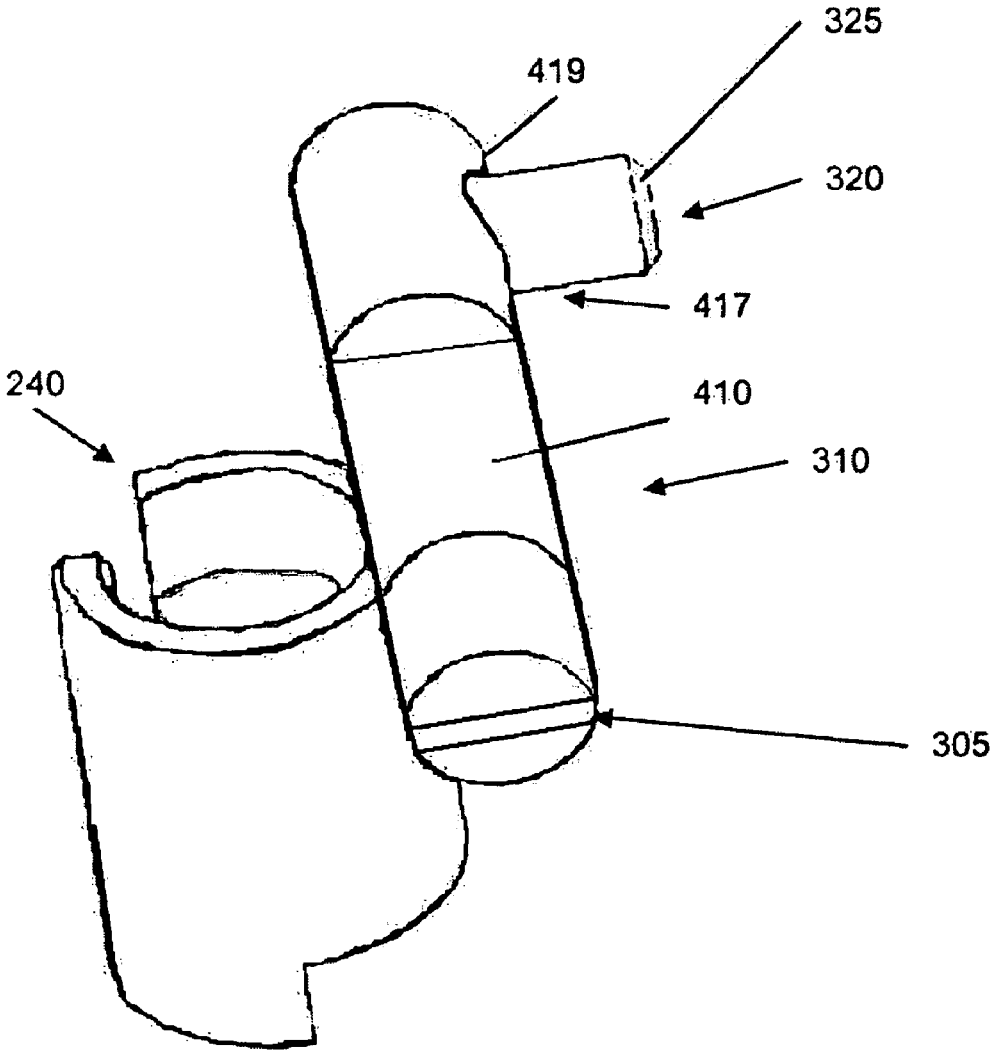
FIGS. 5B and 5C are perspective views of the integral firearms safety lock of the present invention in a locked position in accordance with an exemplary aspect of the present invention.
Figure 5C:
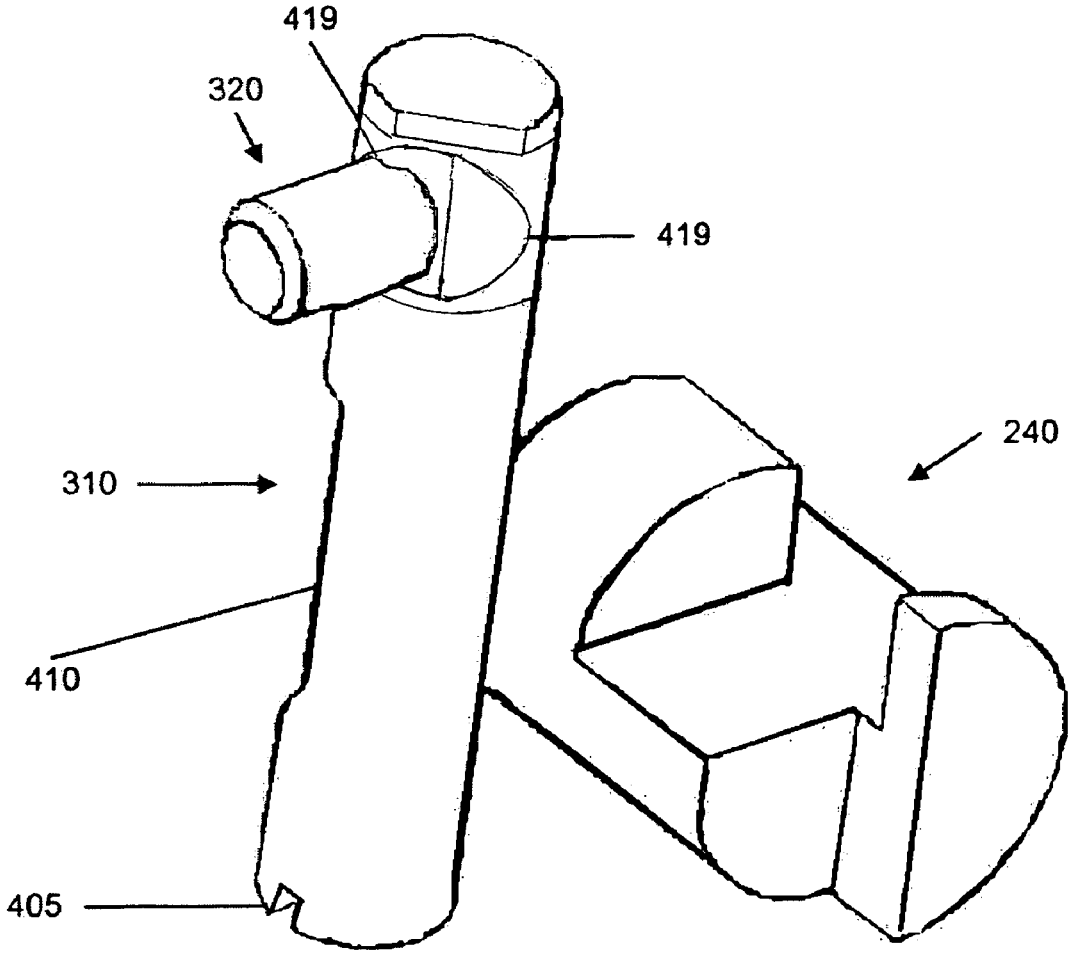

The firearm 100 can again be unlocked when a key is inserted into the indentation 405 located on the face of the locking shaft 310, mounted in the slide 300, and rotated 90 degrees in the opposite direction. As the locking shaft rotates the radial part of the shaft is positioned in the slide, creating an open path for the firing pin safety 240, thus allowing the firing mechanism to be unrestricted. FIGS. 5B and 5C provide different perspective views of the interaction of the locking shaft 310 and the firing pin safety 240.

Figure 6:
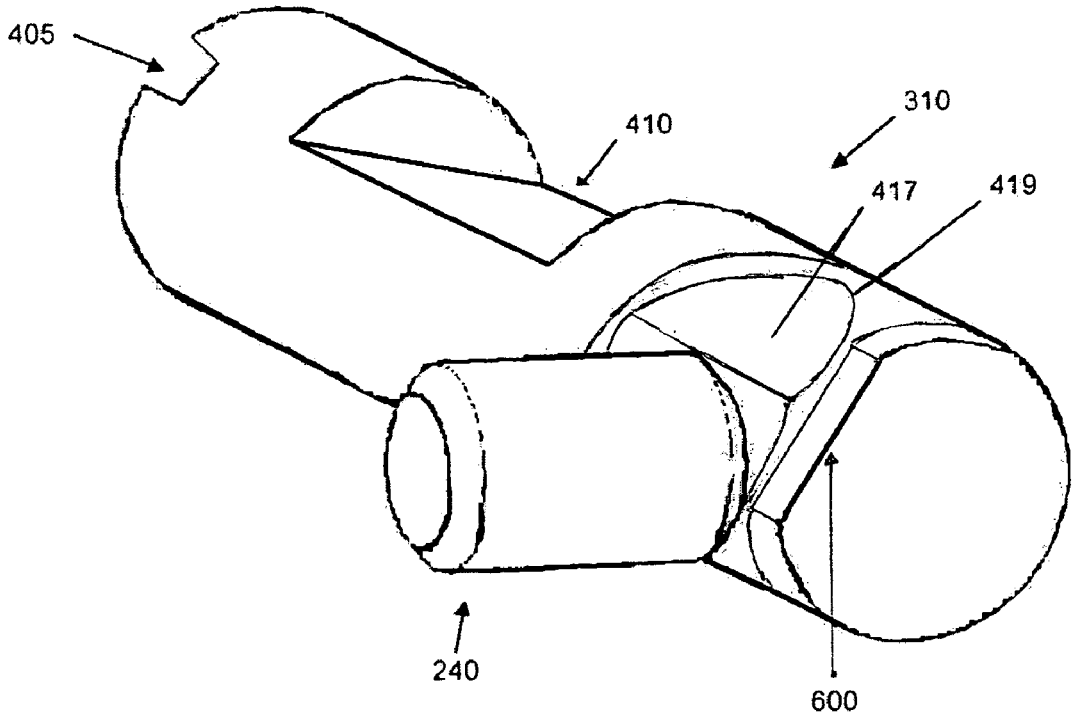
FIG. 6 is a perspective view of the integral firearms safety lock of the present invention between the locked position and the unlocked position in accordance with an exemplary aspect of the present invention.

As illustrated in FIG. 6, in accordance with another exemplary embodiment of the present invention, the locking shaft 310 can also include a chamfer 600 (also illustrated in FIG. 4B) which can include a 45 degree angle cutout on the ridge between the two detents 415 and 417. This midpoint position between the two detent positions on the locking shaft 310 is the required position for the detent pin 320 in order for removal of the locking shaft 310 from the slide 300 of the firearm.

It is, therefore, apparent that there has been provided, in accordance with the present invention, an integral firearms safety lock. While this invention has been described in conjunction with a number of embodiments, it is evident that many alternatives, modifications and variations would be or are apparent to those of ordinary skill in the applicable arts. For example, the exact location of the integral firearms safety lock can be varied, for example, based on the type of firearm. Furthermore, the key can be any device that is adapted to cooperate with the locking shaft to facilitate locking and unlocking. Accordingly, it is intended to embrace all such alternatives, modifications, equivalents and variations that are within the spirit and scope of this invention.

What is claimed is:

1. An integral firearms safety lock for preventing movement of a firing pin safety in a firearm, comprising:

a firing pin safety for preventing movement of a firing pin; and a locking shaft for preventing movement of the firing pin safety, the locking shaft including a recess, wherein the locking shaft can be rotated between an unlocked position and a locked position, and wherein, in the unlocked position, the locking shaft permits movement of the firing pin safety through the recess and the firing pin safety can move without contacting the locking shaft, and, in the locked position, the locking shaft prevents movement of the firing pin safety by directly contacting the firing pin safety.

2. The integral firearms safety lock of claim 1, wherein the locking shaft further comprises a contact area, and wherein a detent pin contacts the locking shaft in the contact area.

3. The integral firearms safety lock of claim 2, wherein the contact area of the locking shaft further comprises:

a first detent including a first stop and a second detent including a second stop.

4. An integral firearms safety lock for preventing movement of a firing pin safety in a firearm, comprising:

a firing pin safety for preventing movement of a firing pin;

a locking shaft for preventing movement of the firing pin safety, said locking shaft comprising a recess and a contact area with said contact area having a first detent including a first stop and a second detent including a second stop; and a detent pin contacting the locking shaft in the contact area;

wherein the locking shaft can be rotated between an unlocked position and a locked position, such that, in the unlocked position, the locking shaft permits movement of the firing pin safety and, in the locked position, the locking shaft contacts the firing pin safety to prevent movement of the firing pin safety, and the detent pin is positioned in said first detent when the locking shaft is in an unlocked state and is positioned in said second detent when the locking shaft is in a locked state.

5. The integral firearms safety look of claim 2, wherein the locking shaft and the detent pin are integral to the firearm.

6. The integral firearms safety lock of claim 2, wherein the locking shaft further comprises:

a chamfer to enable removal of the locking shaft from the firearm.

7. The integral firearms safety lock of claim 6, wherein the chamfer comprises a 45 degree angle cut out between the contact area and the end of the shaft.

8. The integral firearms safety lock of claim 5, wherein the locking shaft and the detent pin are located in holes in a slide of the firearm.

9. The integral firearms safety lock of claim 5, wherein the detent pin contacts a detent pin spring that biases the detent pin against the locking shaft.

10. The integral firearms safety lock of claim 4, wherein the first and second detents are positioned on the shaft so that a rotation of the locking shaft by 90 degrees changes the state of the integral firearms safety lock from either an unlocked state to a locked state or a locked state to an unlocked state.

11. The integral firearms safety lock of claim 1, wherein when in the locked position, the locking shaft contacts a cutout portion of the firing pin safety.

12. The integral firearms safety lock of claim 1, wherein the locking shaft further comprises:

an interface for actuation of the locking shaft from either an unlocked state to a locked state or a locked state to an unlocked state.

13. The integral firearms safety lock of claim 2, wherein the detent pin further comprises tapered ends.

* * * * *